US008043109B2

(12) United States Patent
Bishop et al.

(10) Patent No.: US 8,043,109 B2
(45) Date of Patent: Oct. 25, 2011

(54) WIRE TO BOARD CONNECTOR

(75) Inventors: Peter Bishop, Cambs (GB); Norman Huntley, Herts (GB)

(73) Assignee: AVX Corporation, Myrtle Beach, SC (US)

( * ) Notice: Subject to any disclaimer, the term of this patent is extended or adjusted under 35 U.S.C. 154(b) by 0 days.

(21) Appl. No.: 12/820,644

(22) Filed: Jun. 22, 2010

(65) Prior Publication Data

US 2011/0021061 A1 Jan. 27, 2011

Related U.S. Application Data

(60) Provisional application No. 61/228,805, filed on Jul. 27, 2009.

(51) Int. Cl.
*H01R 13/627* (2006.01)

(52) U.S. Cl. ..... 439/357

(58) Field of Classification Search ..... 439/357, 439/76.1

See application file for complete search history.

(56) References Cited

U.S. PATENT DOCUMENTS 5,378,161 A 1/1995 Loder
6,007,366 A * 12/1999 Torii et al. ..... 439/397
6,050,845 A 4/2000 Smalley, Jr. et al.
6,962,511 B2 11/2005 Gutierrez et al.
7,021,946 B2 4/2006 Koizumi et al.
7,090,529 B1 8/2006 Wang
7,320,616 B1 * 1/2008 Legrady et al. ..... 439/404
7,585,187 B2 9/2009 Daily et al.
7,621,752 B2 11/2009 Lin et al.
2009/0203254 A1 * 8/2009 Weber et al. ..... 439/541

OTHER PUBLICATIONS

AVX "New Product Update" Screen Shots.
UK Patent Office Search Report, Nov. 5, 2010.

* cited by examiner

*Primary Examiner* — Javaid Nasri
(74) *Attorney, Agent, or Firm* — Dority & Manning, P.A.

(57) ABSTRACT

An electrical connector configured for connecting wires to components includes a female component defining a socket with electrical contacts therein. A male component includes an insulative base body with contacts having a first section configured for receipt of a conductive core of an insulated wire, and an insulative plug member that extends transversely from the base body. The electrical contacts have a second section that extends at least partially onto the plug member. In mating contact of the male and female components, the plug member is inserted into the socket such that the electrical contacts on the plug member engage against the electrical contacts in the socket to electrically connect the wires to the electrical component.

18 Claims, 5 Drawing Sheets

WIRE TO BOARD CONNECTOR

PRIORITY CLAIM

The present application claims priority to U.S. Provisional Application Ser. No. 61/228,805, filed Jul. 27, 2009.

FIELD OF THE INVENTION

The present invention relates generally to the field of electrical connectors, and more particularly to type of connector used to connect one or more insulated wires to a component, such as a printed circuit board (PCB), and more particularly to an LED PCB.

BACKGROUND

Various types of connectors are known in the art for forming connections between an insulated wire and any manner of electronic component. These connectors are typically available as sockets, plugs, and shrouded headers in a vast range of sizes, pitches, and plating options. Many of these conventional connectors are referred to as Insulation Displacement Connectors (IDC) in that they include one or more contact elements incorporating a set of blades or jaws that cut through the insulation around the wire and make electrical contact with the conductive core in a one-step process, thus eliminating the need for wire stripping and crimping, or other wire preparation. IDCs are used extensively in the telecommunications industry, and are becoming more widely used in printed circuit board (PCB) applications.

AVX Corporation of Myrtle Beach, S.C., USA, offers a line of low profile IDC wire to board connectors (Series 9175 -9177) that are surface mounted to a circuit board prior to insertion of wires into contact slots with the aid of a hand tool. This process cuts the wire insulation and enables the conductive wire cores to form a secure conductive joint with the connector.

U.S. Pat. No. 6,050,845 describes an IDC assembly that can be mounted to a circuit board and secured thereto prior to terminating conductors to the connector. The electrical connector includes a housing having at least one conductor-receiving aperture and an associated terminal-receiving passageway extending from a board mounting face and intersecting each conductor-receiving aperture U.S. Pat. No. 7,320,616 describes an IDC specifically configured for SMT mounting to a PCB. The connector assembly has at least one contact member with a piercing, cutting or slicing end that is slideably disposed within a main body, and a mounting end that extends from the main body and is attached to a printed circuit board using conventional SMT processes.

IDC wire to board connectors are not suited for all applications, particularly where a rugged connection is required and space is limited between the connected components. For example, the IDCs in the above cited references are relatively complicated in that they require all or a portion of the main body to be movable or slidable relative to the contacts to make final connection with the wires after ends of the contacts have been inserted into through holes in the PCB or surface mounted to the PCB. In addition, a perception to some in the industry is that IDCs are not well suited for stressful environments wherein the electrical component is subjected to prolonged shock and vibrations because the wires tend to move or pull out of the contact blades.

The present invention provides an alternative to IDC wire to board connectors that is rugged, reliable, and allows for easy connection and disconnection of the connector components.

SUMMARY

Objects and advantages of the invention will be set forth in part in the following description, or may be obvious from the description, or may be learned through practice of the invention.

In accordance with aspects of the invention, an electrical connector is provided that is particularly well suited for connecting one or more insulated conductive core wires to an electrical component, such as a PCB. The connector is particularly useful in lighting applications wherein connection is made to one or more LED boards in a light fixture or other LED component. It should, however, be appreciated that connectors according to the invention are not limited to use with LED boards or any other type of board, but may used in any application wherein a secure electrical connection is desired between wires and any other type of component. The connectors will be described herein as used to connect wires to boards for illustrative purposes only.

In a particular embodiment of an electrical connector configured for connecting wires to components, the connector includes a female component having an insulative body defining a socket. At least two electrical contacts are held in the insulative body, with each contact having a first section at a bottom surface of the insulative body spaced apart a distance (i.e., a pattern) corresponding to a connector pad footprint on an end of an intended electrical component, such as a PCB, and a second section that extends into the socket.

The connector includes a male component having an insulative base body with at least two electrical contacts that have a first section configured for receipt of a conductive core of an insulated wire. The male component further includes an insulative plug member that extends transversely from the base body, with the electrical contacts having a second section that extends at least partially onto the plug member. In mating contact of the male and female components, the plug member is inserted into the socket such that the electrical contacts on the plug member engage against the electrical contacts in the socket to electrically connect the wires to the electrical component.

The electrical contacts in the male and female components may take on various shapes and configurations. For example, in a particular embodiment, the second sections of the electrical contacts in the socket are spring biased into engagement with the second sections of the electrical contacts of the male plug member. In this embodiment, the electrical contacts in the female component may be generally U-shaped, with the biased second section defined by an upper leg of the U-shaped contact that extends into the open socket, and with the first section of the electrical contact defined by an opposite leg of the U-shaped contact that extends through an opening in the insulative body to the bottom surface of the insulative body.

In a unique embodiment of the connector, the male component may include a top cover member that fits onto the base body over the first sections of the electrical contacts. In addition, the top cover member may include a latch device configured to extend over and engage the female component in a connected state of the male and female components to prevent inadvertent separation of the components.

The male component may include a platform for receipt of the plurality of insulated wires, with the first sections of the respective electrical contacts disposed on the platform. In addition, the wire platform may include a clamping surface for a wire retention device designed to secure the plurality of wires to the platform. The wire retention device may be, for example, a cable tie or similar device.

The female connector component may be attachable to a circuit board or other component by any suitable means, including any manner of known surface mount technology (SMT). For example, the component may be retained on the board by soldering or mechanical means. The body member may include any manner of male or female structure that engages with complimentary female or male structure in the board. In particular embodiments, male structure such as protruding members may be included at any position on the body member that engage in holes or recesses in the board to securely retain the board in position relative to the connector. It should be appreciated that any manner of mounting technology may be incorporated with connectors and component assemblies in accordance with the invention.

The present invention also encompasses any manner of electrical component assembly that incorporates the unique connector element to electrically connect a plurality of wires to an electrical component. For example, the component assembly may include a PCB in electrical mating contact with a plurality of conductive wires via the electrical connector. The connectors are particularly well suited for connecting a plurality of wires to an LED board in a light fixture, or any other type of LED application.

Particular embodiments of the unique connector are described in greater detail below by reference to the examples illustrated in the drawings.

DETAILED DESCRIPTION

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present invention encompass these and other modifications and variations as come within the scope and spirit of the invention.

Figure 1:
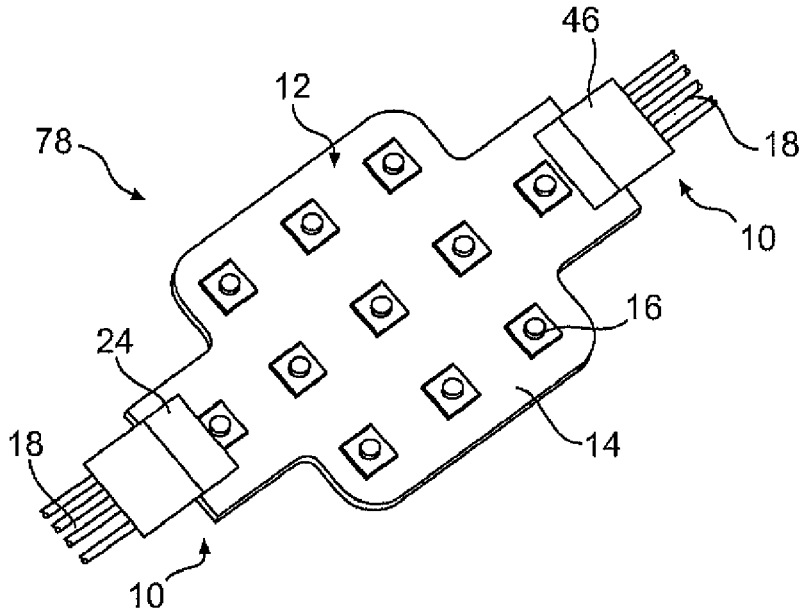
FIG. 1 is a perspective view of an embodiment of a connector according to aspects of the invention used to connect a plurality of conductive core wires to an LED board.

An exemplary embodiment of an electrical connector 10 according to aspects of the invention is illustrated in the various figures. Referring to FIG. 1, the connector 10 is configured for connecting the conductive core of one or more insulated wires 18 to any manner of electrical component 12. The component 12 is illustrated in the figures as a board component 14, such as a PCB, including an LED PCB (an LED board) having a plurality of LED lights 16. It should be readily appreciated that the component 12 may be any type of electronic component having a footprint of contact pads thereon wherein it is desired to connect a respective wire 18 to each of the contact pads for any purpose. For ease of explanation and illustration, the connector 10 is illustrated and referred to herein in the context of connecting wires to a board, such as a PCB or an LED board 14.

The components of this connector 10 can take on various shapes and configurations for their intended purpose. In the embodiment of the connector 10 illustrated in the figures, a female component 24 is configured for surface mounting onto a board 14, for example onto the surface of an LED board 14 as illustrated in FIG. 1. A separate male component 46 is configured for engaging with the female component 24 to electrically connect a plurality of wires to the board 12, as described in greater detail below.

Referring particularly to FIGS. 2 and 9-11, the illustrated embodiment of the female component 24 includes an insulative body 26 having an internal socket 28 defined therein, for example between side walls 44 and a top wall 45. The insulative body 26 can take on various shapes and sizes, and is generally formed of any suitable insulative material, such as a high temperature plastic material such as nylon-46 high temperature resistant nylon. Other insulative materials are well known to those skilled in the art and may be used in the components of a connector 10 of the present invention.

At least two electrical contacts 30 are held in the body 26 of the female component 24. Any number of contacts 30 may be configured in the body 26 depending on the desired contact footprint (i.e., a 2-way, 3-way, 4-way contact, and so forth). Each of the contacts 30 has a first section 32 disposed at a bottom surface 40 of the body 26 that engages against respective contact pads (not shown) on the board 12. The first sections 32 are spaced along the bottom surface 40 at a distance and pattern corresponding to a separation distance and pattern of the corresponding contact pads 22 on the board 14, as generally appreciated by those skilled in the art.

Figure 2:
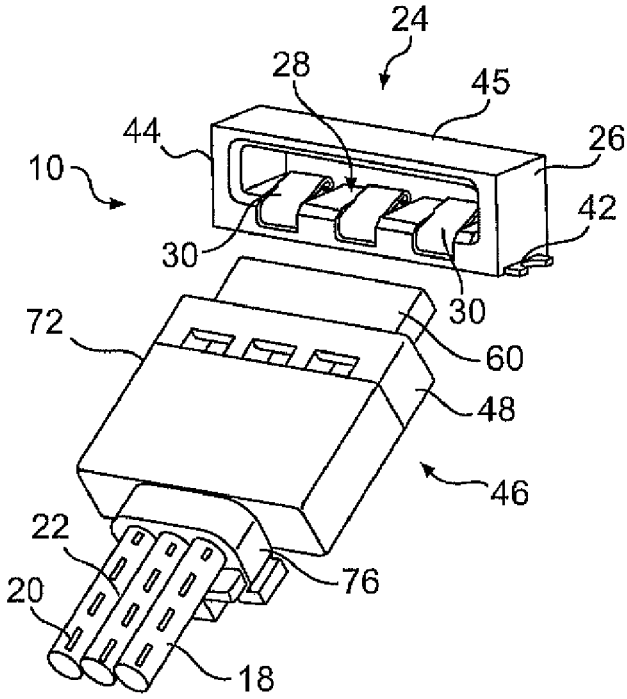
FIG. 2 is a perspective view of the male and female components of an embodiment of the connector.
Figure 3:
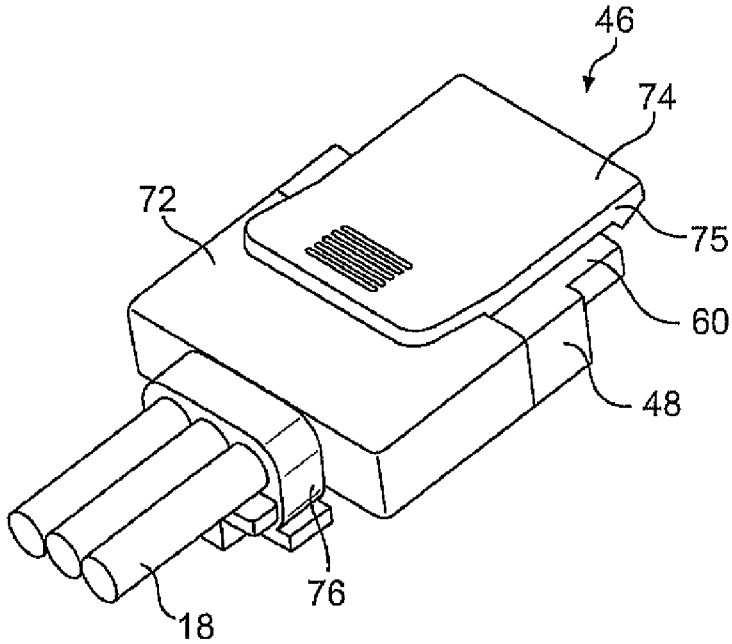
FIG. 3 is a perspective view of an embodiment of a male component of the connector mated with a plurality of conductive core wires.
Figure 9:
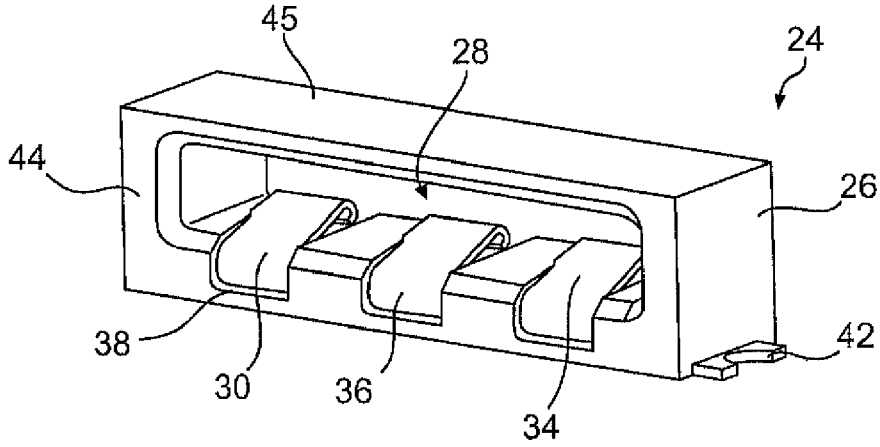
FIG. 9 is a perspective view of an embodiment of a female component of the connector.
Figure 10:
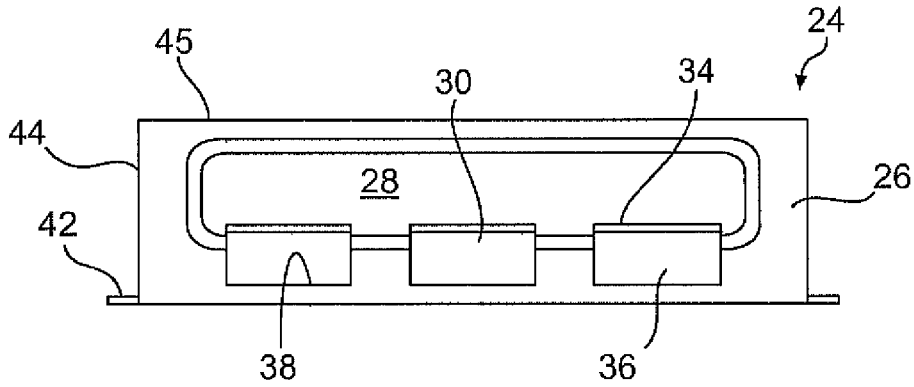
FIG. 10 is perspective end view of the female component of FIG. 9.
Figure 11:
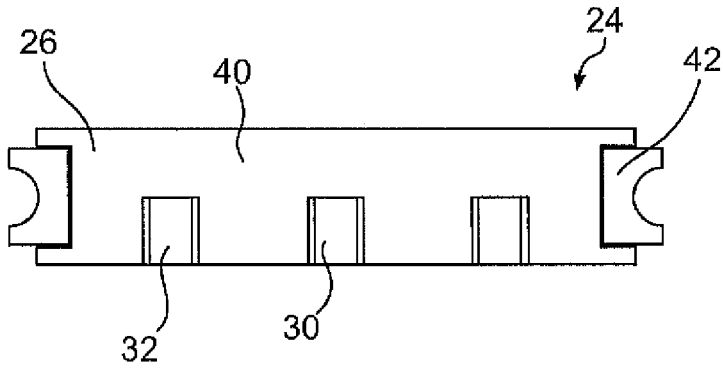
FIG. 11 is a bottom perspective view of the female component of FIG. 9.

Contacts 30 in the female component 24 may include a second section 34 that extends into the open socket 28, as particularly illustrated in FIGS. 2 and 9. The second section 34 may be spring biased into the socket 28 as the result of a bend 36 in the contact 30, The contacts 30 in the illustrated embodiments is a generally U-shaped strip member with the first section 32 of the contact 30 being defined in the lower section of the U-shaped member along the bottom surface 40 of the body member 26. The first section 32 may extend through an opening or slot 38 in the body 26 near the bottom surface 40 of the body. The other leg of the U-shaped contact 30 is defined by the bend 36 and extends into the open socket 28, with the bend 36 imparting a degree of spring or resiliency to the second section 34. The U-shaped contact 30 may bend around a post or portion of the body 26, or the contact 30 may be retained in slots or other engaging structure defined in any portion of the body 26, such as any manner of spring arms, barbs, pinch points, grooves, ledges, friction fits, and so forth. It should be readily appreciated that any suitable means may be employed to retain the contacts 30 within the body 26. For example, the contacts 30 may be molded into the body 26, or retained by any mechanical means.

Figure 4:
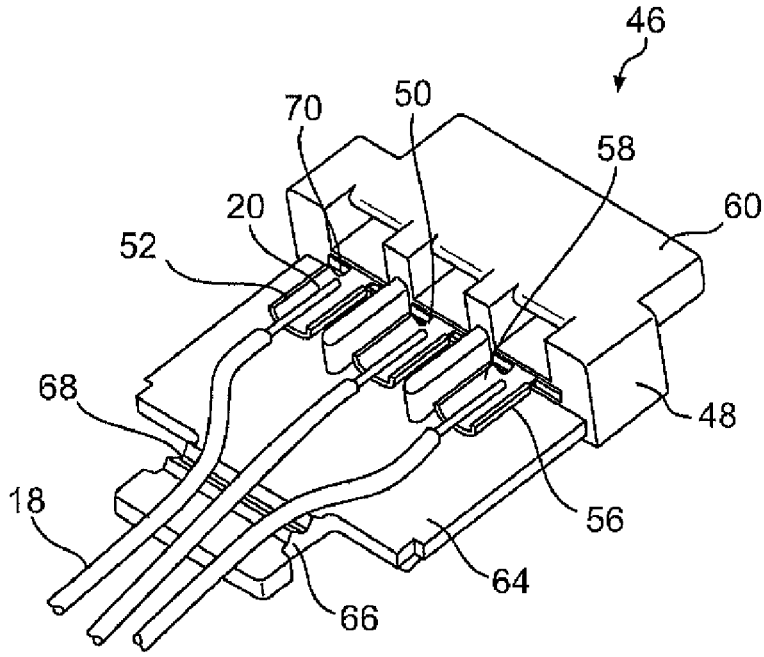
FIG. 4 is a perspective view of the male component of FIG. 3 with the cover member removed.
Figure 5:
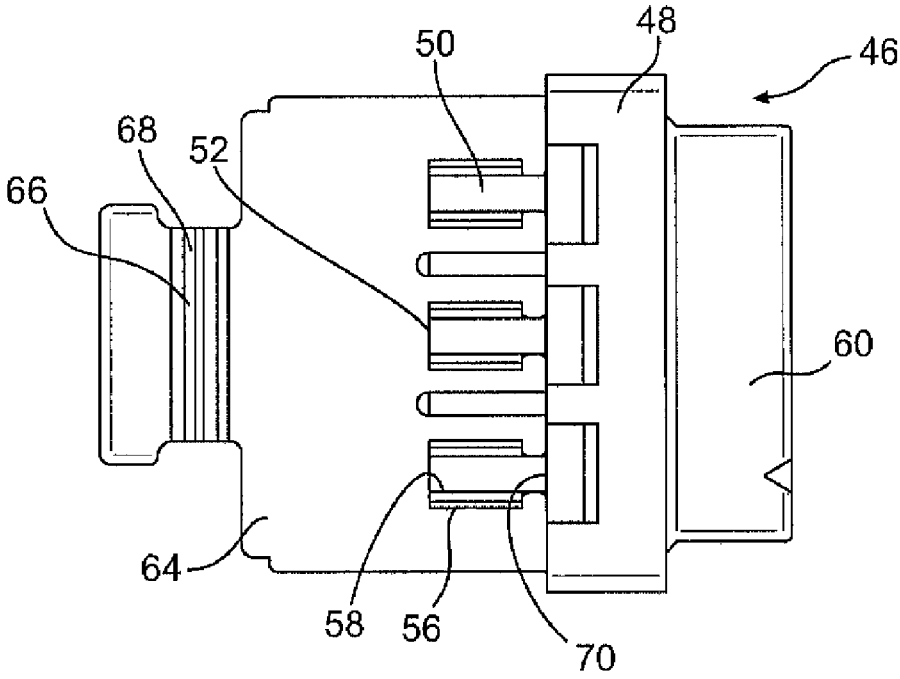
FIG. 5 is a top view of the male component of FIG. 4.
Figure 6:
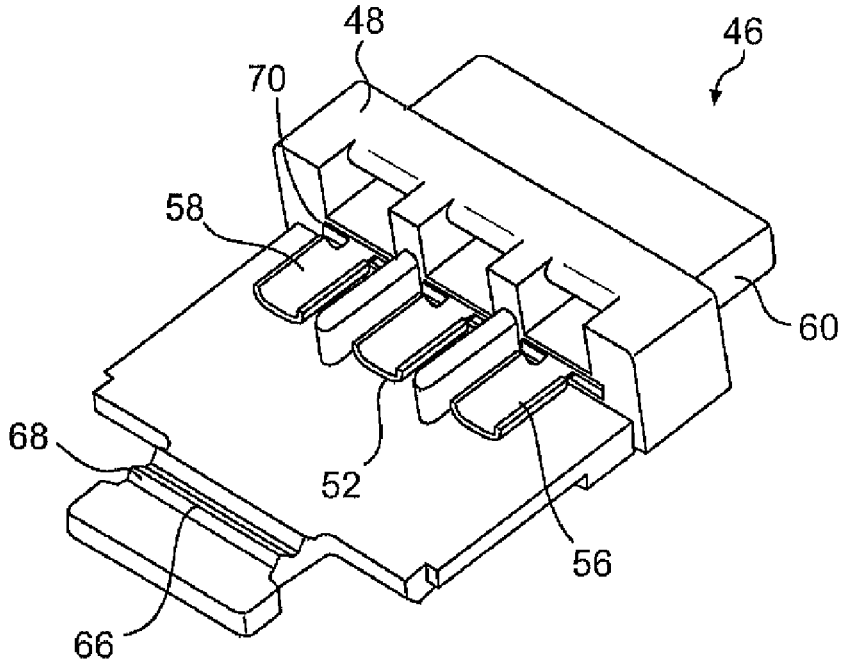
FIG. 6 is an alternative perspective view of the male component of FIG. 5.

The connector 10 includes a male component, such as the component 46 illustrated in FIGS. 3-8, that is attached to one or more wires 18 and serves to electrically connect the wires 20 to the component 12 via the female component 24. The male component 46 may include an insulative base body 48 formed from any suitable insulative material. The body 48 has at least two electrical contacts 50 retained thereby. The contacts 50 may have a first section 52 configured for receipt of a conductive core 20 of an insulated wire 18, as illustrated in FIGS. 4 and 6. The first section 52 may be configured as a bed 58 for receipt of the wire core 20, which is exposed upon stripping a portion of the wire insulation 22. The bed 58 may be defined by upturned lips 56 that provide individual solder beds for each respective wire core 20. In other embodiments, the wire core 20 may be crimped to the first sections 52, or mated to the first sections 52 of the contacts 50 by any other suitable means. In an alternative embodiment, the first section 52 may be configured as an insulation displacement connector (IDC) that electrically mates the wire 20 to the contact 50 without stripping the insulation 22.

Figure 7:
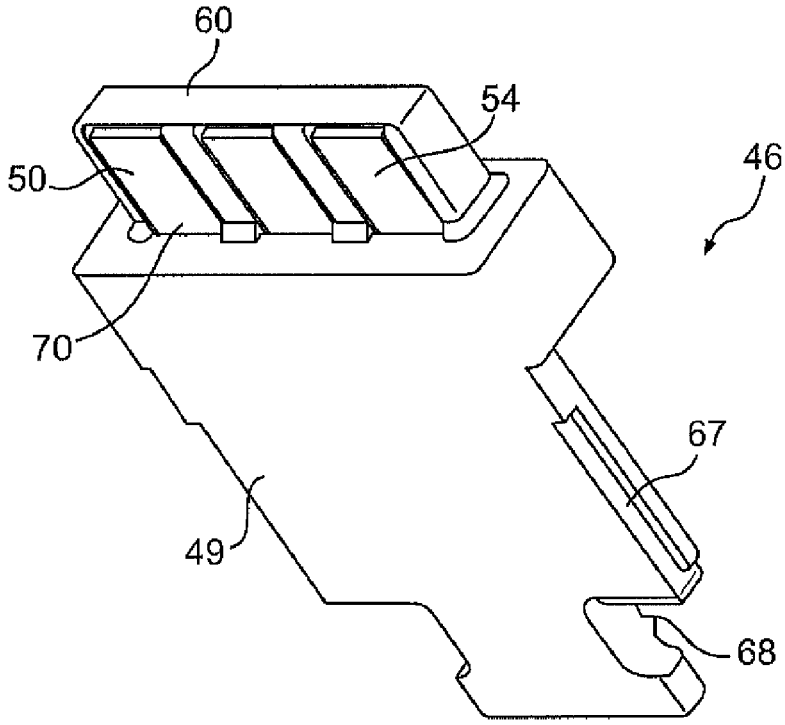
FIG. 7 is a bottom perspective view of the male component of FIG. 6.
Figure 8:
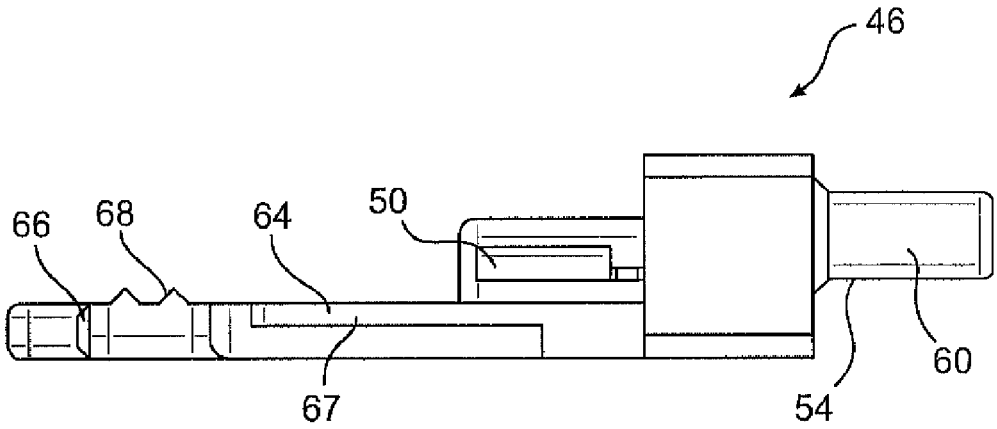
FIG. 8 is a side perspective view of the male component of FIG. 6.

The male component 46 includes an insulative plug member 60 that extends transversely from the base body 48. The electrical contacts 50 in the male component 46 have a second section 54 that extends at least partially onto the plug member 60, as illustrated in FIG. 7. For example, the electrical contacts 50 may extend through an opening 70 in the base body 48 generally at a location where the plug member 60 extends transversely from the base body 48, and onto a bottom surface of the plug member 60. The contacts 50 may include any number of bends to accommodate this configuration within the body 48 and along the plug member 60. As with the female component 24, the contacts 50 may be retained in the male component 46 by any suitable means. For example, the contacts 50 may be molded directly into the plug member 60 and/or body 48, or retained by any suitable mechanical means.

Referring to FIGS. 1 and 2, it is readily appreciated that for mating electrical connection between the wire cores 20 and component 12, the plug member 60 extending transversely from the male component 46 is pushed into the open socket 28 in the female component 24 mounted on the component 12. The second section 54 of the contacts 50 exposed on the plug member 60 along the bottom surface of the plug member engage in pressing contact with the biased second sections 34 of the contacts 30 in the socket 28, which face upward in the socket 28.

The female component 24 may be retained on the top surface of the component 12 by any suitable surface mount technology. For example, in the illustrated embodiments, the female component 24 includes surface mount brackets 42 for mounting onto contact pads on the board 14 by soldering or any other conventional means known and practiced in the art.

The male component 46 may include a platform 64 that extends transversely from the main portion of the body 48. This platform 64 is particularly configured for providing support and retention of the plurality of wires 18 that are engaged with the connector 10. In this regard, the platform 64 may include a clamping surface 66 for receipt of a wire harness or retention device 76 that clamps around the plurality of wires 18 and secures the wires relative to the platform 64. The retention device 76 may be any manner of clamping device that wraps around the wires 18 and a portion of the platform 64, such as a conventional cable tie as particularly illustrated in FIG. 3. The platform 64 may include a plurality of ribs 68 against which the wires 18 are pressed into frictional engagement by tightening of the cable tie. It should be appreciated that other wire retention features may be utilized. For example, recesses or channels may be defined in the platform 64 for each individual wire, and so forth.

In a particularly unique embodiment, the male component 46 may include a top cover member 72 that is pressed onto or otherwise attached to the body 48. For example, the cover 72 may be pressed onto ledges 67 or other engaging structure provided on the platform 64 or other portions of the body 48. The cover 72 may be disposed over the individual solder connections between the conductive cores 20 and the sections 52 of the respective contacts 50.

In addition, the top cover member 72 may include a latch device 74 (FIG. 3) configured to extend over and engage the female component 24 in a connected state of the male and female components to prevent inadvertent separation of the components. The latch device 74 may be, for example, a member that pivots relative to the body 48 with a lip 75 that engages over an edge or other portion of the body 26 of the female component 24.

It should be readily appreciated that the components of the connector 10 described herein are not limited in any way to a particular construction material. In a desirable embodiment, the various contacts may be, for example, copper alloy with selective gold over nickel tin plated on the contact tails. The surface mount brackets may be, for example, a tin plated copper alloy. The insulative body components may be, for example, nylon-46.

As previously mentioned, the present invention also encompasses any manner of electrical component assembly that incorporates the unique connector 10 of the present invention to electrically connect a plurality of wires to an electrical component. This concept is illustrated generally in FIG. 1 wherein a component assembly 78 is illustrated. As discussed, the component assembly 78 includes an electrical component 12 in the form of an LED board 14. The connectors 10 are particularly well suited for connecting a plurality of wires to the LED board 14 in a light fixture or any other type of LED application. It should be readily appreciated that the component assembly 78 is not limited by any particular type of electrical component 12.

It should be readily appreciated by those skilled in the art that various modifications and variations can be made to the embodiments of the invention illustrated and described herein without departing from the scope and spirit of the invention. It is intended that such modifications and variations be encompassed by the appended claims.

What is claimed is:

1. An electrical connector configured for connecting wires to components, said connector comprising:

a female component comprising an insulative body defining a socket, and at least two electrical contacts held in said insulative body with a first section at a bottom surface of said insulative body spaced apart a distance corresponding to a connector pad footprint on an end of an electrical component, and a second section that extends into said socket; and a male component comprising an insulative base body with at least two other electrical contacts that have a first section configured for receipt of a conductive core of an insulated wire, said male component further comprising an insulative plug member that extends transversely from said base body, said other electrical contacts having a second section that extends at least partially onto said plug member; and wherein in mating contact of said male and female components, said plug member is inserted into said socket such that said other electrical contacts on said plug member engage against said electrical contacts in said socket to electrically connect said wires to said electrical component.

2. The connector as in claim 1, wherein said second sections of said electrical contacts in said socket are spring biased into engagement with said second sections of said other electrical contacts of said male plug member.

3. The connector as in claim 1, wherein said electrical contacts in said female component are generally U-shaped, said biased second section defined by an upper leg of said U-shaped contact that extends into said socket, and said first section of said electrical contact defined by a leg of said U-shaped contact that extends through an opening in said insulative body to said bottom surface of said insulative body.

4. The connector as in claim 1, wherein said male component comprises an insulative wire platform, said first sections of said other electrical contacts disposed on said wire platform, said wire platform further comprising a clamping surface.

5. The connector as in claim 4, further comprising a wire retention device that engages said wire platform at said clamping surface, said wire retention device configured to retain the plurality of wires in electrical contact with said connector engaged against said male component.

6. The connector as in claim 1, wherein said male component further comprises side walls defining separate contact positions for said first sections of said other electrical contacts.

7. An electrical connector configured for connecting wires to components, said connector comprising:

a female component comprising an insulative body defining a socket, and at least two electrical contacts held in said insulative body with a first section at a bottom surface of said insulative body spaced apart a distance corresponding to a connector pad footprint on an end of an electrical component, and a second section that extends into said socket; and a male component comprising an insulative base body with at least two other electrical contacts that have a first section configured for receipt of a conductive core of an insulated wire, said male component further comprising an insulative plug member that extends transversely from said base body, said other electrical contacts having a second section that extends at least partially onto said plug member; and wherein in mating contact of said male and female components, said plug member is inserted into said socket such that said other electrical contacts on said plug member engage against said electrical contacts in said socket to electrically connect said wires to said electrical component; and wherein said male component further comprises a top cover member that fits onto said base body over said first sections of said other electrical contacts.

8. The connector as in claim 7, further comprising a latch device on said top cover member, said latch device configured to extend over and engage said female component in a connected state of said male and female components to prevent inadvertent separation of said male and female components.

9. An electrical component assembly, comprising:

an electrical component having a contact pad footprint defined thereon;

a plurality of wires;

an electrical connector maintaining each of said wires in electrical mating contact with a respective said contact pad, wherein said electrical connector comprises:

a female component comprising an insulative body defining a socket, and at least two electrical contacts held in said insulative body with a first section at a bottom surface of said insulative body spaced apart a distance corresponding to a connector pad footprint on an end of the electrical component, and a second section that extends into said socket;

a male component comprising an insulative base body with at least two other electrical contacts that have a first section configured for receipt of a conductive core of an insulated wire, said male component further comprising an insulative plug member that extends transversely from said base body, said other electrical contacts having a second section that extends at least partially onto said plug member; and wherein in mating contact of said male and female components, said plug member is inserted into said socket such that said other electrical contacts on said plug member engage against said electrical contacts in said socket to electrically connect said wires to the electrical component.

10. The electrical component assembly as in claim 9, wherein said second sections of said electrical contacts in said socket are spring biased into engagement with said second sections of said other electrical contacts of said male plug member.

11. The electrical component assembly as in claim 9, wherein said electrical contacts in said female component are generally U-shaped, said second section of said electrical contacts defined by an upper leg of said U-shaped contact that extends into said socket, and said first section of said electrical contact defined by a leg of said U-shaped contact that extends through an opening in said insulative body to said bottom surface of said insulative body.

12. The electrical component assembly as in claim 9, wherein said male component comprises an insulative wire platform, said first sections of said other electrical contacts disposed on said wire platform, said wire platform further comprising a clamping surface for a wire retention device.

13. The electrical component assembly as in claim 12, further comprising a wire retention device that engages said wire platform at said clamping surface, said wire retention device configured to retain the plurality of wires in electrical contact with said connector engaged against said male component.

14. The electrical component assembly as in claim 9, wherein said male component further comprises side walls defining separate contact positions for said first sections of said other electrical contacts.

15. The electrical component assembly as in claim 9, wherein said electrical component comprises a PCB.

16. The electrical component assembly as in claim 9, wherein said electrical component comprises a LED board.

17. An electrical component assembly, comprising:

an electrical component having a contact pad footprint defined thereon;

a plurality of wires;

an electrical connector maintaining each of said wires in electrical mating contact with a respective said contact pad, wherein said electrical connector comprises:

a female component comprising an insulative body defining a socket, and at least two electrical contacts held in said insulative body with a first section at a bottom surface of said insulative body spaced apart a distance corresponding to a connector pad footprint on an end of the electrical component, and a second section that extends into said socket;

a male component comprising an insulative base body with at least two other electrical contacts that have a first section configured for receipt of a conductive core of an insulated wire, said male component further comprising an insulative plug member that extends transversely from said base body, said other electrical contacts having a second section that extends at least partially onto said plug member;

wherein in mating contact of said male and female components, said plug member is inserted into said socket such that said other electrical contacts on said plug member engage against said electrical contacts in said socket to electrically connect said wires to the electrical component; and wherein said male component further comprises a top cover member that fits onto said base body over said first sections of said electrical contacts.

18. The electrical component assembly as in claim 17, further comprising a latch device on said top cover member, said latch device configured to extend over and engage said female component in a connected state of said male and female components to prevent inadvertent separation of said male and female components.

* * * * *